US008938924B1

(12) United States Patent
Smith, Jr.

(10) Patent No.: US 8,938,924 B1
(45) Date of Patent: Jan. 27, 2015

(54) STANDING SEAM METAL PANEL ROOF RECOVER

(71) Applicant: McElroy Metal Mill, Inc., Bossier City, LA (US)

(72) Inventor: Charles L. Smith, Jr., Houston, TX (US)

(73) Assignee: McElroy Metal Mill, Inc.

( * ) Notice: Subject to any disclaimer, the term of this patent is extended or adjusted under 35 U.S.C. 154(b) by 0 days.

(21) Appl. No.: 14/251,011

(22) Filed: Apr. 11, 2014

(51) Int. Cl.

| | |
|---|---|
| ***E04B 1/62*** | (2006.01) |
| ***E04D 3/362*** | (2006.01) |
| ***E04D 3/367*** | (2006.01) |
| ***E04D 3/361*** | (2006.01) |

(52) U.S. Cl.
CPC ..... *E04D 3/362* (2013.01); *E04D 3/364* (2013.01); *E04D 3/361* (2013.01)
USPC ..... 52/395; 52/336; 52/466

(58) Field of Classification Search
CPC ..... E04D 3/366; E04D 3/3608; E04D 3/364; E04D 15/04; E04D 3/362
USPC ..... 52/336, 395, 466
See application file for complete search history.

(56) References Cited

U.S. PATENT DOCUMENTS

| | | | | |
|---|---|---|---|---|
| 4,089,145 | A | 5/1978 | DeVries et al. | |
| 4,099,356 | A | 7/1978 | Graham | |
| 4,213,282 | A | 7/1980 | Heckelsberg | |
| 4,217,741 | A | 8/1980 | Cole | |
| 4,445,305 | A * | 5/1984 | Orie, Sr. | 52/309.9 |
| 4,476,658 | A * | 10/1984 | Johnstone | 52/395 |
| 4,575,983 | A | 3/1986 | Lott, Jr. et al. | |
| 4,649,684 | A * | 3/1987 | Petree et al. | 52/395 |
| 5,134,825 | A | 8/1992 | Berridge | |
| 5,181,360 | A * | 1/1993 | Shingler | 52/520 |
| 5,367,848 | A | 11/1994 | McConnohie | |
| 5,692,352 | A | 12/1997 | Simpson et al. | |
| 5,737,892 | A | 4/1998 | Greenberg | |
| 5,737,894 | A * | 4/1998 | Simpson et al. | 52/520 |
| 6,301,853 | B1 * | 10/2001 | Simpson et al. | 52/520 |
| 6,354,045 | B1 * | 3/2002 | Boone et al. | 52/95 |
| 6,796,097 | B2 | 9/2004 | Fensel et al. | |

(Continued)

OTHER PUBLICATIONS

Ask Todd Miller *Metal Roofing Expert, *Exposed Fastener Metal Roofing: Is it Standing Seam*? http://www.asktoddmiller.com/history/exposed-fastener-metal-roofing-is-it-standing-seam/ (Apr. 6, 2013).

(Continued)

*Primary Examiner* — Basil Katcheves
*Assistant Examiner* — Joshua Ihezie
(74) *Attorney, Agent, or Firm* — Keith B. Willhelm

(57) ABSTRACT

Metal panel standing seam roof recovers installed over existing metal panel standing seam roof. The metal panel standing seam roof recover system comprises a plurality of recover panel clips mounted to the existing roof and a recover attached to the recover panel clips. The recover panel clips are arranged in linear arrays running along the pitch of the existing roof. The recover panel clips are mounted to the cover panels by a clip fastener extending through a cover sidelap or through a shoulder adjacent a cover sidelap formed in the standing seam metal panels of the existing roof. The recover comprises a plurality of elongated metal recover panels having upstanding sides defining lateral edges with a trough therebetween. The recover panels are interconnected along adjacent lateral edges by sidelaps formed on the recover panel clips.

25 Claims, 7 Drawing Sheets

(56) References Cited

U.S. PATENT DOCUMENTS

| | | | | |
|---|---|---|---|---|
| 8,061,087 | B2 | 11/2011 | Ray | |
| 8,327,590 | B2 | 12/2012 | Ray | |
| 8,713,864 | B1 * | 5/2014 | Smith, Jr. | 52/200 |
| 2009/0126303 | A1 | 5/2009 | Ferge et al. | |
| 2010/0275525 | A1 | 11/2010 | Wendelburg et al. | |
| 2011/0016803 | A1 | 1/2011 | Ray | |
| 2012/0279165 | A1 * | 11/2012 | Marshall | 52/655.1 |

OTHER PUBLICATIONS

D. Mckinnis, *Just What is a Standing Seam Metal Roof*? http://www.mckinnisroofing.com/residential-roofing/just-what-is-a-standing-seam-metal-roof/ (Aug. 3, 2011).

MBCI, *MBCI Products—Classic® Series*, (http://www.mbci.com/classic.html).

MBCI, *Metal Roof and Wall Systems Architectural Pricing* (Copyright 2013).

McElroy Metal, Inc., *MasterLok Product Information*, (Rev. Apr. 2012).

*Metal Panel Roof Recover*, U.S. Appl. No. 13/573,282, filed Sep. 7, 2012.

Schulte Building Systems, Inc., *Serious Performance Through Superior Design—Introducing a New Age of Standing Seam Metal Roofing Above and Beyond the Rest—TS-324 Technology* (© 2008).

WiseGEEK, *What is Standing Seam Roofing*? http://www.wisegeek.com/what-is-standing-seam-roofing.htm.

* cited by examiner

STANDING SEAM METAL PANEL ROOF RECOVER

FIELD OF THE INVENTION

The present invention relates to metal panel roof covers and, more particularly, to metal panel roof covers for installation over an existing standing seam metal roof.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. More typically, however, metal covers for roofs are metal panel covers, that is, they utilize rather elongated metal panels installed along the slope of a roof.

Metal panel roofs utilize various flashings and other components where the fields of a roof terminate or intersect, such as the eaves, gables, valleys, ridges, and hips of a roof. Even in roofs having many different intersecting or overlapping fields, however, the basic construction of metal panel roofs across the major expanse of a roof is fairly standard. Most commonly, an array of spaced, elongated support members or "purlins" is mounted across the structural rafters of a roof substructure. The purlins run horizontally across the rafters, i.e., across the slope of the roof. Layers of insulation and various barriers may be, and for climate controlled buildings usually are installed. Decking also may be provided for additional support. A cover is provided by a series of rather elongated, mostly flat, interconnected metal panels.

Each cover panel is typically about a foot to three feet in width. Though they may be cut to any length, they commonly are 30 to 40 feet long and may run as long as 200 feet. The lateral edges of the panels are bent in various configurations to form upwardly extending sides and a trough in the middle. The trough is where most of the water will be shed from the roof. Adjacent panels are joined along their upwardly extending sides to create relatively narrow seams which are elevated above the trough. The panels are laid out such that the seams run vertically, i.e., with the slope of the roof. The panels also may have one or more ridges running vertically through the trough, and it is those vertically oriented seams and ridges that create the distinctive appearance that consumers associate with metal roofs. More importantly, however, since the seams between adjacent panels are formed a few inches above the troughs where most rain will be shed, metal panel roofs can be very resistant to leaking.

Raised-seam, metal panel roof covers may be classified according to the manner in which the panels are secured to the purlins. So called "through panel" or "exposed" fastener covers are characterized by the use of screws or other fasteners that penetrate through the cover panels. The panels typically are laid over a roof so that their sides overlap and form a raised, often trapezoidal shaped seam or "lap" rib. The panels then are joined together along the lap rib by, e.g., gasketed screws. Gasketed screws also are driven through the trough to fasten the panels to the purlins. Leakage around the fastener, at least initially, is not a significant problem. Over time, however, the elastomeric material from which the screw gaskets are fabricated can deteriorate, and leaks tend to develop around penetrating fasteners.

"Standing seam" covers can provide better resistance to leakage over longer periods of time, even for relatively flat roofs where ponding water is a concern and, in the eyes of many beholders, provide a more beautiful roof. Standing seam covers use concealed clips to secure the panels to the underlying purlins instead of unsightly and leak-prone penetrating fasteners. For example, individual panel clips may be installed in vertical lines from one purlin to the next along what will become a seam line between panels. Panels are then installed between the vertical lines of clips, with the upturned seam edges of the panels abutting and mating with the clips and each other. There are no penetrations through the panels when clips are used. Moreover, all gaps between the panels and the clips are elevated well above the trough through which most water runoff occurs. Thus, standing seam panel covers provide better, longer resistance to leakage as compared to covers using screws or other "through panel" fasteners that penetrate the panels.

Providing adequate uplift resistance, however, can be a greater challenge in standing seam panel covers. That is, most damage to roof covers is caused by wind blowing over the surface of the roof. That air flow forms low pressure areas over the roof and creates an uplift force in much the same way that the wing of an aircraft creates lift forces. While such forces are essential for flight, the uplift forces created by powerful winds over a roof can peel metal panels or other roof coverings away from the roof. It is relatively easy to provide a sufficient number of fasteners in exposed fastener covers. Since they are connected only along their seam lines, however, providing a sufficiently secure connection for panels in a standing seam cover is more problematic.

In addition, not all parts of a roof experience the same uplift forces in a given wind. The exposed edges of a roof experience greater uplift forces, and a given surface or field of a roof may be divided into three zones in recognition of such differences. The "edge" zones include those areas within a certain distance, usually around 8 feet, of an eave or gable. If the pitch of a roof is greater than 2 inches per foot of slope, the areas adjacent the ridge and hip of the roof also are considered "edge" zones. The edge zones experience greater wind uplift pressures than most of the roof and typically constitute approximately 15% of a roof's surface. The greatest uplift pressures, however, are in the "corner" zones. Those are the areas where edge zones overlap, and they typically constitute approximately 5% of the surface of a roof. The "field" zone is the rest of the roof field and it constitutes approximately 80% of the roof surface. The field zone experiences the lowest wind uplift pressures. In any event, providing sufficient resistance to wind uplift has been an increasingly important consideration in roof design as property owners and insurers seek to minimize their potential losses from wind damage, especially in hurricane prone areas like the Gulf and lower Atlantic coast.

Examples of standing seam roof covers using non-penetrating clips are disclosed in U.S. Pat. No. 4,575,983 to H. Lott, Jr. et al. The panels disclosed therein are asymmetrical standing seam panels. Asymmetrical panels have mating male-female connections, each panel having a male connection formed in one side and a female connection formed in its other side. Thus, installation must proceed in a certain direction across the roof, and removal for repair must proceed in the opposite direction.

Symmetrical standing seam panels, however, have sides which are identical and are joined with a separate seam cover. Symmetrical panels, therefore, may be installed in either direction. A damaged panel also may be removed for replacement without removing any adjacent panels. Examples of symmetrical standing seam roof covers using non-penetrating individual clips are disclosed in U.S. Pat. No. 4,649,684 to L. Petree et al. Other covers, such as those disclosed in U.S.

Pat. No. 6,354,045 to M Boone et al. and U.S. Pat. No. 5,737,892 to P. Greenberg, utilize individual and elongated, "continuous" clips that are mounted to and span adjacent purlins. While they are more costly than covers using asymmetrical panels, such symmetrical panel covers can offer improved leak protection, better uplift resistance, and longer service life.

Despite the improvements in both the quality of panels and methods of installation, however, many of the metal roofs installed in the past twenty to thirty years have deteriorated to the point where they must be replaced. Removing an existing roof, however, is expensive and highly disruptive for occupants of a building. It also creates large quantities of waste that must be disposed of, and eliminates not only the existing roof, but whatever insulation value the existing roof may have provided. Thus, various covers have been developed to essentially recover an existing roof.

The most economical fix is to simply apply a plastic coating to the roof. Any exposed fasteners, along with seams, penetrations, flashing and the like, typically are caulked or covered with a fabric tape. All surfaces then are primed and the coating, usually a water based acrylic elastomer or a solvent-based butyl rubber or silicone rubber, is applied. Coatings have limited service lives, but have a great cost advantage.

So-called "single ply" covers offer a somewhat better solution at somewhat higher, but still relatively low cost. Rigid foam panels are laid between the seams of the existing metal panel roof. A recovery board, usually plywood, particle board, oriented strand (OSB) board, or fiber reinforced gypsum board, is installed over the foam panels. A rubber sheet, such as an ethylene propylene diene monomer (EPDM), thermoplastic polyolefin (TPO), polyvinyl chloride (PVC), ketone ethylene ester (KEE), such as Elvaloy™, is then adhered to the recovery board.

Another approach has been to install new metal panels over existing metal panel roofs. Installing a new metal cover, or "recover" over an existing cover offers significantly longer service life. Nevertheless, because that extended service life come with a much greater cost, metal panel recovers, especially standing seam metal panel recovers remain at a significant disadvantage relative to cheaper alternatives.

That increased cost is derived largely from the complexity of standing seam metal recovers and the cost of their various components. For example, standing seam metal recovers most commonly require the installation of new purlins over the existing roof panels. The new purlins then provide a base to which new panels may be attached, either with exposed fasteners or with clips.

In one common recover, for example, brackets are attached to the existing purlins, and a new purlin is mounted on the brackets above each existing purlin. A simpler recover, such as that disclosed in U.S. Pat. No. 5,367,848, uses notched purlins, the notches accommodating the seams and ridges in existing panels so that new purlins may be attached directly to existing purlins without brackets. Needlessly complicated recovers also have been devised, however, such as those disclosed in U.S. Pat. No. 8,061,087 and U.S. Pat. No. 8,327,590 to G. Ray. The recovers disclosed in Ray '087 and '590 require the installation of even more purlins above and between the purlins in the existing roof. In any event, new panels are attached to the new purlins, preferably with panel clips.

Recover systems have been developed, however, that do not rely on installation of new purlins over an existing cover. Clips are mounted to the existing purlins through the existing cover panels. Some systems have used "individual" clips, i.e., clips that mounted to a single purlin, and asymmetrical recover panels. Another recover system which does not rely on installing new purlins is disclosed in applicant's pending patent application, U.S. Ser. No. 13/573,282, filed Sep. 7, 2012. That application discloses a recover system which utilizes individual panel clips and "continuous" clips, i.e., relatively elongated clips that span at least two purlins. Both the individual and continuous clips are mounted to the existing purlins through the existing cover panels. Recover panels then are installed on the clips.

Such approaches can offer significant material savings, but they have drawbacks. Some of the material savings derived by eliminating new purlins is offset by the increased material cost of the clips. The clips typically are mounted in the trough of the existing cover panels, and other factors being equal, they necessarily will be taller than clips designed for mounting atop new purlins.

It also may not be easy to attach clips to existing purlins. The surface of existing panels, especially in the trough areas, may be uneven, making it more difficult to align an array of clips. Insulation also may be installed between the purlins and panels in an existing roof. The presence of such insulation not only makes it more likely that an aging roof will have surface irregularities, but it also may mean that the existing roof cannot provide adequate support for individual panel clips. That is especially true as the thickness of an insulation layer increases and its load capacity decreases. When a clip is a subjected to forces having even a relatively small horizontal component, relatively high torque forces may transmitted to the base of the clip, which can create harmful flexing and stress in a panel installed above thick, soft insulation.

Any system for installing a new metal panel roof cover, of course, also must provide sufficient wind uplift resistance. Moreover, all components should be designed with consideration of not only the cost of manufacturing the component, but also in view of how easily the component and the overall system may be installed and repaired. Material and labor costs are a major component of any roofing project. This is especially critical because there are so many cheaper, albeit less effective, recovering systems on the market.

The statements in this section are intended to provide background information related to the invention disclosed and claimed herein. Such information may or may not constitute prior art. It will be appreciated from the foregoing, however, that there remains a need for new and improved systems, apparatus and methods for installing metal panels over existing metal roofs. Such disadvantages and others inherent in the prior art are addressed by various aspects and embodiments of the subject invention.

SUMMARY OF THE INVENTION

The subject invention, in its various aspects and embodiments, is directed generally to metal panel standing seam roof "recovers," that is, metal panel roof covers that are installed over an existing roof. One aspect of the invention provides for a metal panel roof recover system which is installed over an existing roof. The existing roof has a support frame which includes an array of spaced purlins running across the pitch of the existing roof. A plurality of panel clips are attached to the purlins and arranged in linear arrays running along the pitch of the existing roof. A cover is attached to the panel clips. The cover comprises a plurality of elongated metal cover panels having upstanding sides with a trough therebetween. The upstanding sides define shoulders and lateral edges. The cover panels are interconnected along adjacent lateral edges by sidelaps formed on the panel clips with the cover sidelaps extending along the pitch of the existing roof and extending vertically from the shoulders on adjacent the cover panels.

The metal panel standing seam roof recover system comprises a plurality of recover panel clips mounted to the existing roof and a recover attached to the recover panel clips. The recover panel clips are arranged in linear arrays running along the pitch of the existing roof. The recover panel clips are mounted to the cover panels by a clip fastener extending through a cover sidelap or through one of the shoulders adjacent the cover sidelap. The recover comprises a plurality of elongated metal recover panels having upstanding sides defining lateral edges with a trough therebetween. The recover panels are interconnected along adjacent lateral edges by sidelaps formed on the recover panel clips.

Other aspects provide such recovers where the recover panel clips are mounted to the cover panels by a first the clip fastener extending horizontally through a cover sidelap and a second the clip fastener extending vertically through one of the shoulders adjacent the cover sidelap. The first and second clip fasteners may or may not extend through a panel clip in the existing roof. The second clip fasteners may or may not extend into a purlin in the existing roof.

Another aspect provides such recovers where the recover system comprises cover fasteners attaching the cover panels to the purlins. Such cover fasteners may comprise fasteners extending through the other the shoulder adjacent the cover sidelap and fasteners comprise fasteners extending through the trough of the cover panels.

Especially preferred embodiments include recovers where the recover panel clips are mounted to the cover panels in the existing roof by a first the clip fastener extending through a the cover sidelap in the existing roof and a second the clip fastener extending through one of the shoulders adjacent the cover sidelap and wherein the recover system comprises a cover fastener extending through the other the shoulder adjacent the cover sidelap and a cover fastener extending through the trough of the cover panels in the existing roof.

Yet another aspect and embodiment provides recovers where cover panels in the existing roof are spaced above the purlins and the cover fasteners include a spacer extending between the fastener and the purlin.

Various aspects will utilize recovers where the cover panels in the existing roof are asymmetrical. Other aspects will utilize recovers where the cover sidelaps in the existing roof are mechanically seamed sidelaps, snap-in sidelaps, or hook and roll in place sidelaps. Still other aspects are directed to recovers where the roof recover panels are symmetrical panels.

Yet other aspects and embodiments provide recovers wherein the recover panel clips comprise a vertical body and a horizontal bottom flange and wherein the first clip fastener extends through the clip body and the second clip fastener extends through the clip bottom flange.

Further embodiments and aspects provide recover systems where the recover panel clips include individual panel clips installed in a field zone of the existing roof and continuous panel clips installed in an edge zone of the existing roof or where the recover panel clips include individual panel clips installed in a field zone of the existing roof and continuous panel clips installed in a corner zone of the existing roof.

In still other aspects, the invention is directed to metal panel standing seam roof recover system installed over an existing metal panel standing seam roof which comprises a support frame. The support frame includes an array of spaced purlins running across the pitch of the existing roof. A plurality of panel clips are attached to the purlins and arranged in linear arrays running along the pitch of the existing roof. A cover is attached to the panel clips. The cover comprises a plurality of elongated metal cover panels having upstanding sides with a trough therebetween. The cover panels are interconnected along adjacent upstanding sides by sidelaps formed on the panel clips. The cover sidelaps extend along the pitch of the existing roof and extending vertically from the cover panels.

The roof recover system comprises a plurality of recover panel clips mounted to the existing roof and arranged in linear arrays running along the pitch of the existing roof. The recover panel clips are mounted to the cover panels by a clip fastener extending through a cover sidelap. A recover is attached to the recover panel clips. The recover comprises a plurality of elongated metal recover panels having upstanding sides defining lateral edges with a trough therebetween. The recover panels are interconnected along adjacent lateral edges by sidelaps formed on the recover panel clips.

In another aspect provides such recovers where the recover system comprises cover fasteners attaching the cover panels to the purlins. Such cover fasteners may comprise fasteners extending through the trough of the cover panels.

Especially preferred embodiments include such recovers where the recover panel clips are mounted to the cover panels in the existing roof by a clip fastener extending through a the cover sidelap in the existing roof and wherein the recover system comprises a cover fastener extending through the trough of the cover panels in the existing roof.

Yet another aspect and embodiment provides such recovers where cover panels in the existing roof are spaced above the purlins and the cover fasteners include a spacer extending between the fastener and the purlin.

Various aspects will utilize such recovers where the cover panels in the existing roof are asymmetrical. Other aspects will utilize recovers where the cover sidelaps in the existing roof are mechanically seamed sidelaps, snap-in sidelaps, or hook and roll in place sidelaps. Still other aspects are directed to recovers where the roof recover panels are symmetrical panels.

Yet other aspects and embodiments provide such recovers wherein the recover panel clips comprise a vertical body and a horizontal bottom flange and wherein the clip fastener extends through the clip body into the sidelaps in the existing roof.

Further embodiments and aspects provide such recover systems where the recover panel clips include individual panel clips installed in a field zone of the existing roof and continuous panel clips installed in an edge zone of the existing roof or where the recover panel clips include individual panel clips installed in a field zone of the existing roof and continuous panel clips installed in a corner zone of the existing roof.

The subject invention also includes methods for installing a metal panel standing seam recover over an existing metal panel standing seam roof. The existing roof comprises a support frame which includes an array of spaced purlins running across the pitch of the existing roof, a plurality of panel clips attached to the purlins, and a cover attached to the panel clips. The cover comprises a plurality of elongated metal panels having upstanding sides. The sides define shoulders and lateral edges. The cover panels are interconnected along adjacent lateral edges by sidelaps formed on the panel clips. The cover sidelaps extending vertically from the shoulders on adjacent the cover panels.

The method comprises providing an array of recover panel clips on the existing roof by attaching the recover panel clips to the vertically extending cover sidelap in the existing roof or to one of the shoulders adjacent the cover sidelap. Elongated metal recover panels then are attached to the recover panel clips by forming sidelaps on the recover panel clips.

Other aspects of the novel methods include attaching the recover panel clips to the vertically extending cover sidelap in the existing roof and to one of the shoulders adjacent the cover sidelap.

Another embodiment includes such methods which include providing an array of individual recover panel clips in a field zone of the existing roof and providing continuous panel clips in an edge zone or corner zone of the existing roof.

Still other aspects provide such methods which include attaching the cover panels in the existing roof to the purlins by installing cover fasteners through the cover panels into the purlins.

Further aspects and embodiments of the novel methods include installing a metal panel standing seam recover over an existing roof which has a support frame including an array of spaced purlins running across the pitch of the existing roof, a plurality of panel clips attached to the purlins, and a cover attached to the panel clips. The cover comprises a plurality of elongated metal panels having upstanding sides. The sides define lateral edges. The cover panels are interconnected along adjacent lateral edges by sidelaps formed on the panel clips. The cover sidelaps extending vertically from the shoulders on adjacent the cover panels.

The method comprises providing an array of recover panel clips on the existing roof by attaching the recover panel clips to the vertically extending cover sidelap in the existing roof. Elongated metal recover panels then are attached to the recover panel clips by forming sidelaps on the recover panel clips.

Other aspects of such novel methods include attaching the recover panel clips to the vertically extending cover sidelap in the existing roof and to one of the shoulders adjacent the cover sidelap.

Another embodiment includes such methods which include providing an array of individual recover panel clips in a field zone of the existing roof and providing continuous panel clips in an edge zone or corner zone of the existing roof.

Still other aspects provide such methods which include attaching the cover panels in the existing roof to the purlins by installing cover fasteners through the cover panels into the purlins.

Finally, still other aspect and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
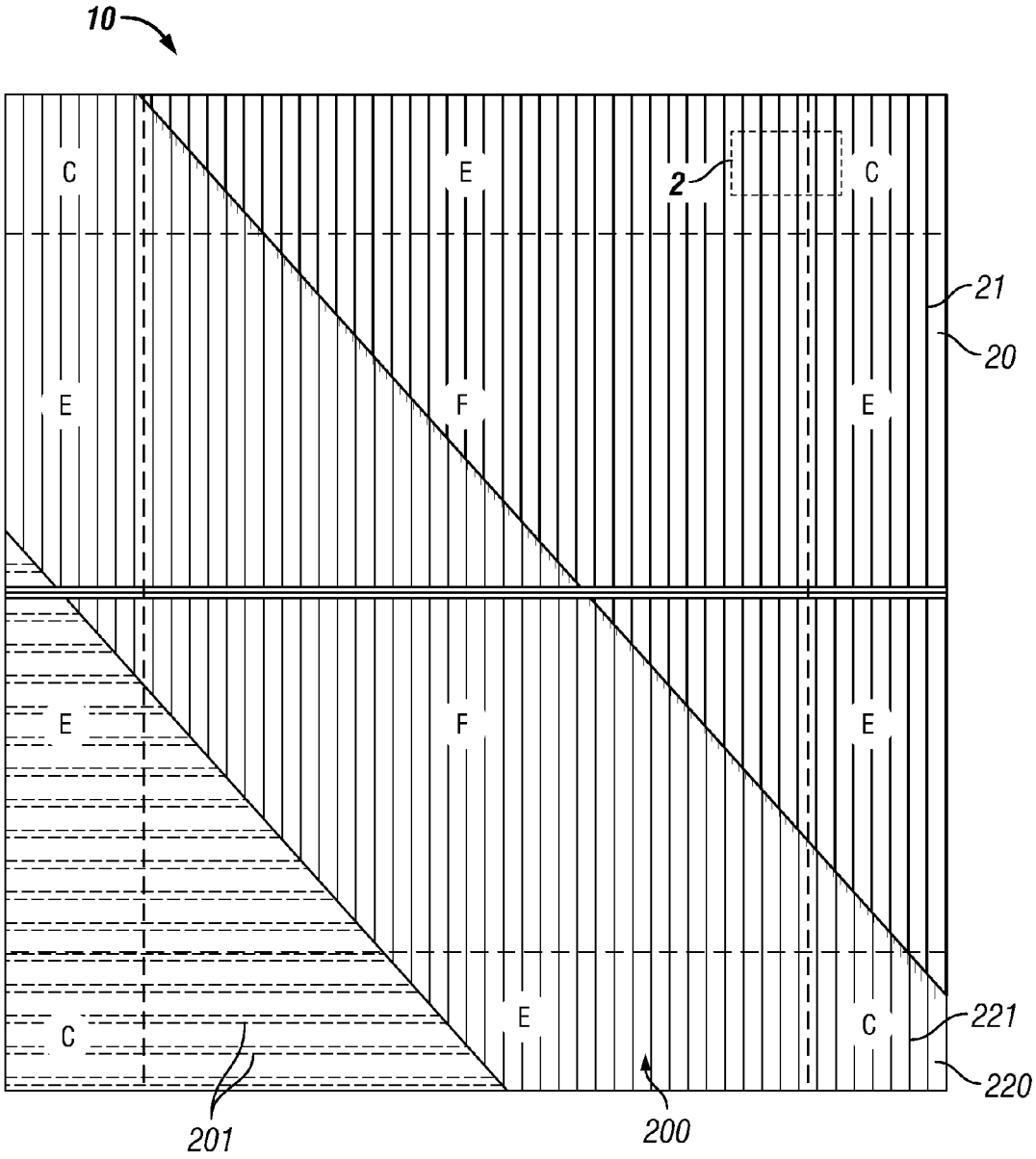
FIG. 1 is a perspective view, including partial tear-away views, of a conventional metal panel roof 200 which has been recovered with a first preferred embodiment 10 of the metal panel roof recovers of the subject invention.

In the drawings and in the description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to metal panel roof covers for installation 26 over an existing roof, that is, to metal panel roof "recovers." The novel metal panel roof 2, recovers may be installed over an existing roof, such as prior an metal roof 200 shown in FIGS. 1-5.

Existing roof 200 is installed over a relatively flat roof support frame (not shown), that it, it is a "structural" roof cover. Structural metal panels are most commonly used over relatively low slope roofs, although even "flat" roofs preferably have a minimum of 0.25 inch per foot of slope to provide runoff. A structural panel roof cover can support its own weight without a deck since the metal panels have higher seams, usually about 3 inches high. The seams of a structural cover are hydrostatic. That is, they are designed to be water tight since the seams may have to withstand pressure from ponding water.

The novel metal panel roof recovers, however, also may be installed over existing "architectural" roof covers. Architectural metal panels are generally installed over relatively steep roofs, those having a minimum slope of about 3 inches per foot of slope, where visual impact or aesthetics may be more valued. Panel seams in architectural metal panel roofs are hydrokinetic, i.e., water shedding. Since the seams are relatively short, usually 0.5 to 1.5 inches high—a supporting deck usually is installed over the roof rafters to provide support for the panels.

Existing roof 200 is typical of conventional asymmetrical, trapezoidal, standing seam metal panel roofs that have been widely installed in great numbers over the past few decades. As shown generally therein, it includes an array of spaced, elongated bar joists or purlins 201. Purlins 201 are mounted on structural rafter beams (not shown) of a roof substructure and run "horizontally" through the roof. That is, purlins 201 are installed and run across the slope of a roof, as opposed to running "vertically" or with the slope.

Purlins 201 may be any type of elongated support member, but are exemplified herein as "Z" purlins of the type widely used in metal roofs and building covers. As seen best in FIG. 2, purlins 201 of existing roof 200 have a flange 202 extending generally horizontally in one direction from the lower end of a vertically oriented body 203. Another flange 204 extends generally horizontally in the other direction from the upper end of body 203. Lower flange 202 provides a base by which purlins 201 are attached to the rafter beams (not shown). Upper flange 204 provides a surface upon which is mounted a series of overlapping elongated panels 220. Lower flange 202 and upper flange 204 also preferably and typically are provided with angled edges to provide greater structural integrity and strength to purlin 201.

Figure 2:
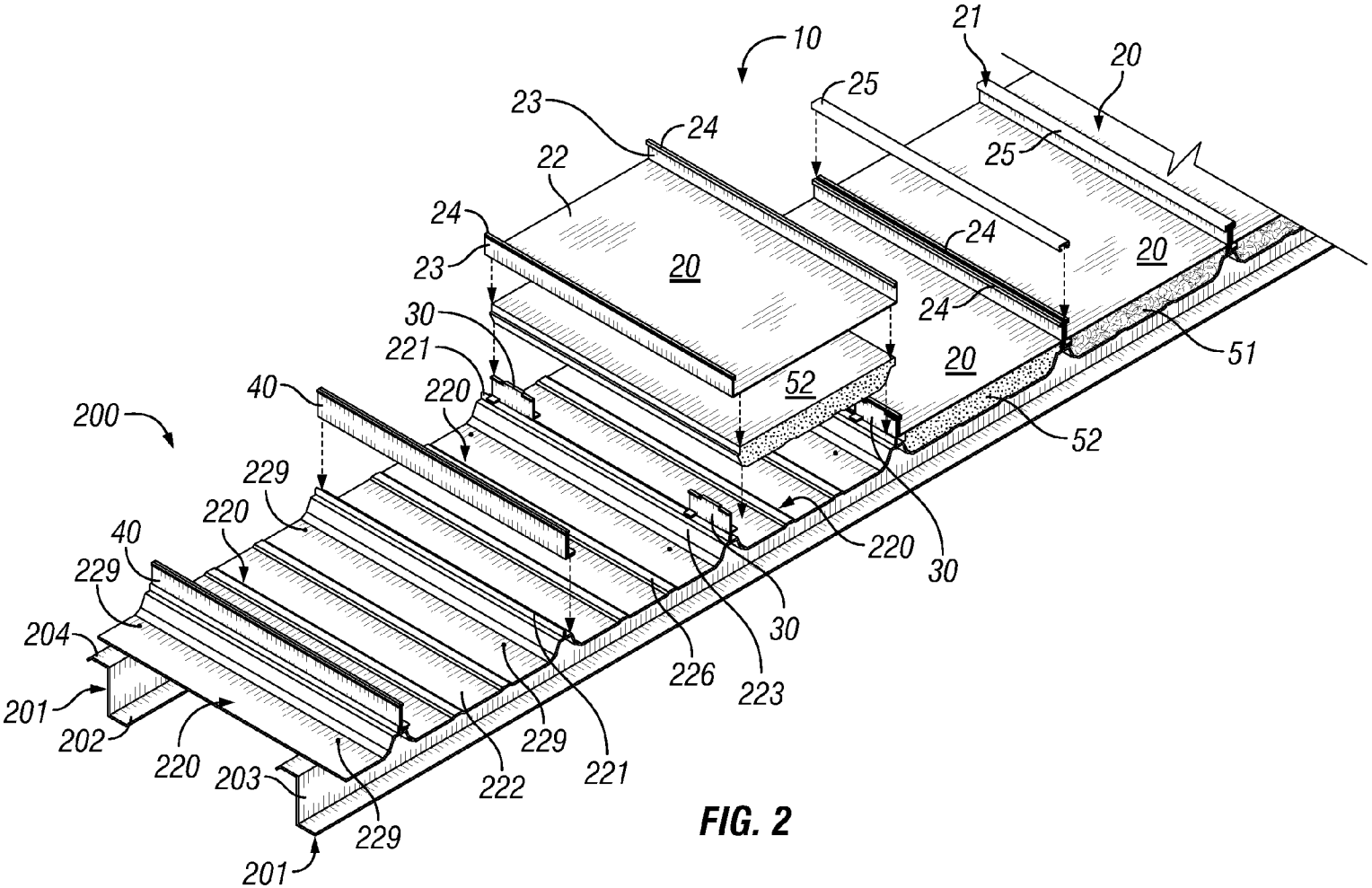
FIG. 2 is a perspective, partially exploded view of a portion of novel roof recover 10 taken generally from an area 2 of FIG. 1, which portion has been installed across a boundary between edge zone E and corner zone C of conventional roof cover 200 (certain components of novel roof recover 10 having been omitted therefrom to better show underlying components)
Figure 3:
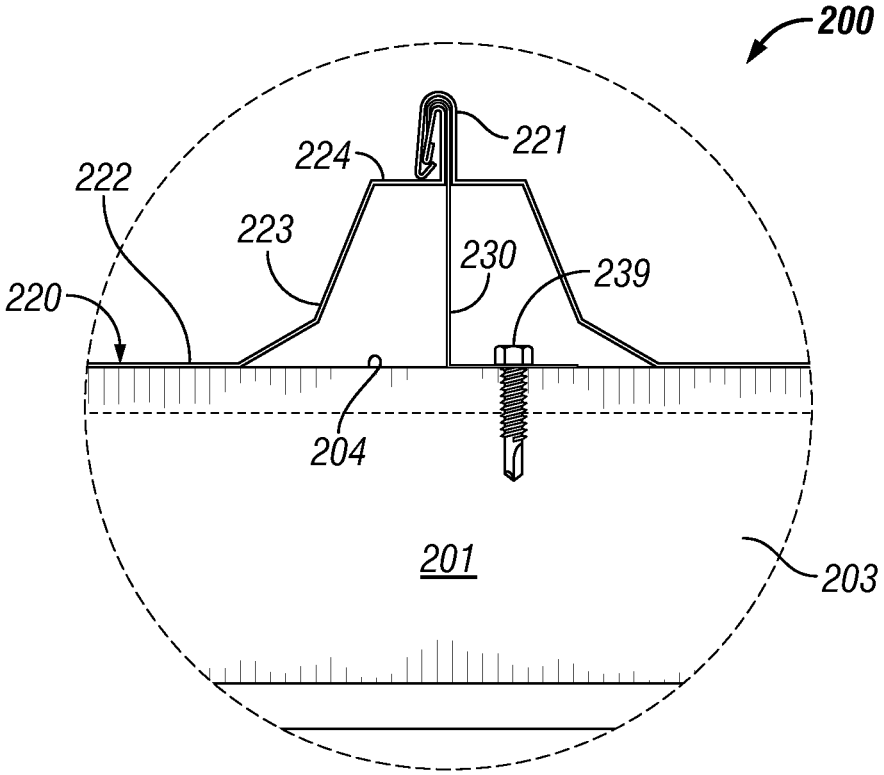
FIG. 3 is an enlarged cross-sectional view, taken generally perpendicular to lap ridges 221, of conventional roof 200 shown in FIGS. 1-2, the components of novel roof recover 10 having been omitted therefrom to better show conventional roof 200.

Panels 220 in existing roof 200 are installed such that they run vertically, that is, with the slope and across purlins 201. As may be seen in FIGS. 2 and 3, existing panels 220 have upturned sides 223, the edges of which are joined to form raised sidelaps or lap ridges 221. Existing panels 220 also have, as is typical of panels of this type, a number of vertical ridges 226 formed in the trough 222 extending between upturned sides 223. Though commonly referred to as trapezoidal panels, when viewed in cross-section as shown in FIG. 3, panel sides 223 do not form, with the upper surface of purlin 201, a trapezoidal shape. The general shape may be viewed as a convex hexagon, but regardless, sides 223 of adjacent panels 220 are joined to provide generally horizontal (relative to the principle plane of roof 200) shoulders 224 from which lap ridges 221-extend upwardly.

The panels in the existing roof are installed and seamed together on panel clips which are mounted on the purlins or other horizontally extending support members in linear arrays running vertically across the purlins. For example, as shown in FIG. 3, existing panels 220 are mounted on panel clips 230. Panel clips 230 are arranged in linear arrays running vertically across purlins 201 and are secured to upper flange 204 of purlins 201 by, e.g., penetrating fasteners such as screws 239. Existing panels 220 are disposed between linear arrays of clips 230. Existing panels 230 are asymmetrical panels, that is, their seam sides 223 are not symmetrical. They are configured such that the lateral edges, that is, the upper portion of seam sides 223 of adjacent panels 220 nest one into the other when installed. The nested lateral edges of seam sides 223 of adjacent panels 220 then are mechanically formed into lap ridges 221 over the upper portion of clips 230.

The novel metal panel roof recovers will be described in relation to standing seam, metal panel roofs in general and to existing metal roof 200 in particular. It is to be understood, however, that the novel roof recovers may be installed over other types of existing standing seam roots without departing from the principles of the present invention. For example, existing metal roof 200 is typical of so-called "mechanically seamed," trapezoidal standing seam metal panel roofs. Panels of this type are available commercially from a number of manufacturers, such as the Masterlock FS standing seam panels sold by McElroy Metal. Other types of trapezoidal, standing seam metal panels are available as well, including so-called "snap-in" panels, such as the Masterlock standing seam panels produced by McElroy Metal, and "hook and roll in place" panels such as those disclosed in U.S. Pat. Nos. 5,692,352, 5,737,894, and U.S. Pat. No. 6,301,853 to H. Simpson et al. and the TS-324 metal panel system licensed by Building Research Systems, Inc. to Schulte Building Systems and other manufacturers. Those standing seam metal panel roofs and others may be repaired and restored with the novel roof recovers as well.

Various preferred embodiments of the novel metal panel roof recovers comprise a plurality of recover panel clips mounted to the existing roof and arranged in linear arrays running along the pitch of the existing roof. The recover panel clips are mounted to the cover panels by clip fasteners extending through a cover sidelap, through a shoulder adjacent the cover sidelap, or through both the cover sidelap and the shoulder. A recover is attached to the recover panel clips. The recover comprises a plurality of elongated metal recover panels having upstanding sides defining lateral edges with a trough therebetween. The recover panels are interconnected along adjacent lateral edges by sidelaps formed on the recover panel clips.

For example, preferred novel roof recover 10 generally comprises roof recover panels 20, individual clips 30, and continuous clips 40. As shown in FIGS. 1-2, recover panels 20 run vertically and are interconnected along their lateral edges by standing seams 21. Standing seams 21 define troughs 22 through which water is shed from roof 10. The upper ends of recover panels 20 extend under a ridge cap 11 provided along a peak line 12 of roof 10. Preferably, each recover panel 20 runs down the entire slope of roof 10 to an cave or valley (not shown). Alternately, the troughs may be provided by two or more panels overlapped at their ends.

The panels used in the novel recover metal roofs are the same type of standing seam panels as are conventionally used in metal panel roof covers. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. Preferably, the former is mounted on a trailer or truck so that panels may be fabricated on a job site.

Figure 4:
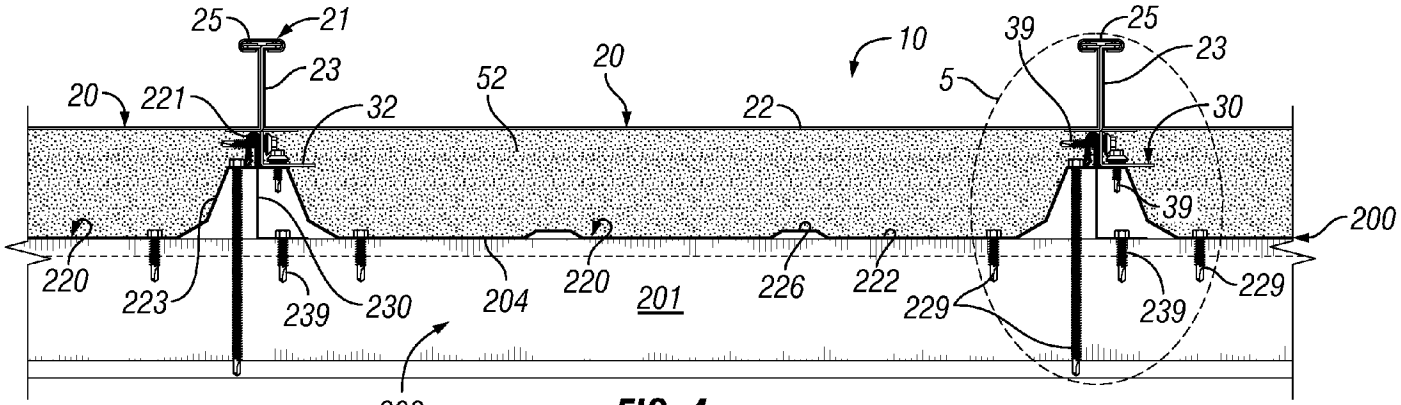
FIG. 4 is a cross-sectional view, taken generally perpendicular to lap ridges 21 and 221, of novel roof recover 10 shown in FIGS. 1-2.
Figure 5:
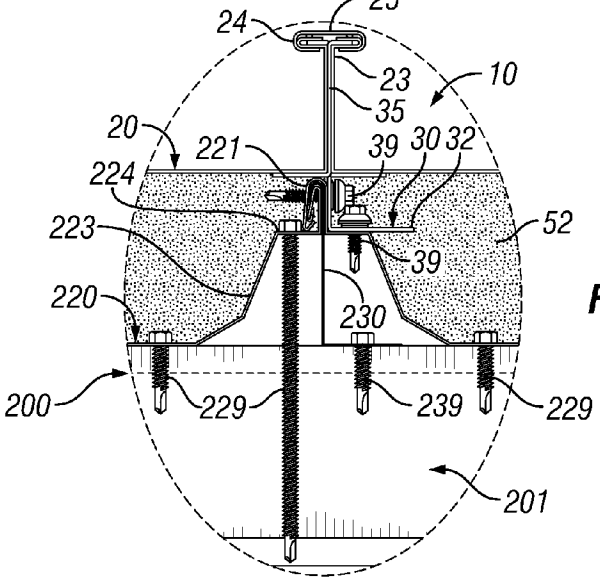
FIG. 5 is an enlarged, detailed view of portion 5 of the view shown in FIG. 4.

Panel clips are used to secure recover panels to an existing roof and to facilitate the formation of standing seams between the recover panels. Individual clips 30 and continuous clips 40, for example, are used to secure recover panels 20 over existing roof 200 and to facilitate the formation of seams 21 between laterally adjacent panels 20 as shown in FIGS. 2 and 4-5. They are disposed on the upper surface of one of the shoulders 224 formed in sides 223 of existing panels 220 in linear arrays running vertically across existing roof 200. Recover individual clips 30 and continuous clips 40 are attached to the existing panels 200 by fasteners, such as screws 39 and 49, extending through side laps 221 and shoulders 224 formed in sides 223 of existing panels 200.

Preferred embodiments of the subject invention include metal panel roof recovers in which individual panel clips are installed in the field of an existing roof and continuous clips are installed in corner zones, and where either individual or continuous clips are installed in edge zones of the existing roof. For example, novel roof recover 10 includes large field zones F, edge zones E, and corner zones C as shown in FIG. 1. Individual panel clips 30 are installed in field zones F and edge zones E and continuous clips 40 are installed in corner zones C. That may be best appreciated by reference to FIG. 2, which is a section of novel recover roof 10 installed across a boundary between an edge zone E 14 and a corner zone C.

As exemplified therein, individual clips 30 are mounted on panels 220 of existing roof 200 in linear arrays. The arrays of individual clips 30 run vertically through field zones F and edge zones E of existing roof 200 adjacent lap ridges 221 along what will become the seam lines for recover panels 20. Thus, the width of recover panels 20 will be coordinated with the width of existing panels 220, and the linear arrays of clips 30 are separated horizontally by a distance substantially equal to the width of recover panels 20.

Continuous clips 40 are installed in corner zones C of roof 200. Like individual clips 30, continuous clips 40 are mounted adjacent lap ridges 221 in existing roof 200 along what will become seam lines for recover panels 20. Thus, they too are offset from each other by a distance approximately equal to the width of panels 20. In contrast to individual clips 30, however, continuous clips 40 are elongated and extend across adjacent purlins 201 in existing roof 200. Continuous clips 40, therefore, provide continuous support for panels 20 through corner zones C, thus providing greater resistance to wind uplift in those areas experiencing the greatest uplift forces.

If desired or necessary, increased resistance to wind uplift may be provided in roof edge zones by providing continuous clips in those zones instead of individual clips as in recover roof 10. Similarly, in those zones where they are employed, individual clips typically will be installed on every purlin along the seam line as are clips 30 in recover roof 10. If resistance to wind uplift is not a great concern, however, it may not be necessary to install an individual clip on every purlin. It also will be appreciated that continuous clips preferably extend across the entire corner zones or, if employed therein, the edge zones of a roof. Shorter continuous clips may be employed, however, and arranged in a line across the zone such that their ends overlap, abut, or are spaced somewhat apart with the result that support for recover panels is provided across substantially the entire run through the zone. In any event, by selectively installing either individual or continuous clips across the roof, it is possible to provide a standing seam roof recover with increased resistance to wind uplift in those areas requiring greater resistance, yet which requires fewer parts, may be installed more easily, and has lower material costs.

Figure 6:
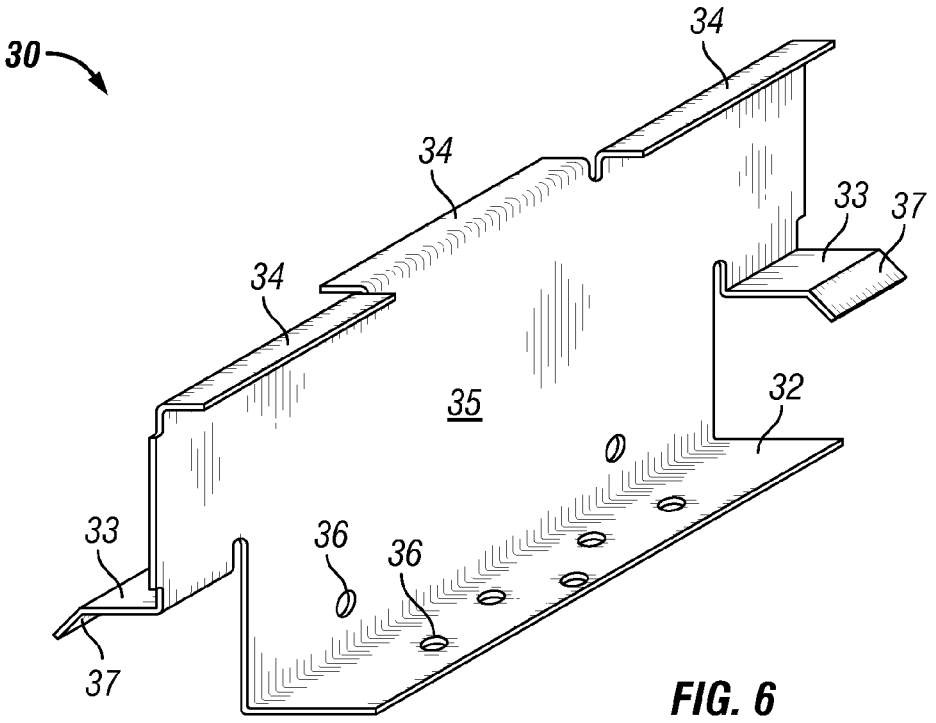
FIG. 6 is a perspective view of a preferred embodiment 30 of individual panel clips 30 of the subject invention, individual panel clip 30 being used in novel roof recover 10 shown in FIGS. 1-2 and 4-5.

More particularly, as seen best in FIG. 6, individual clips 30 which are installed in field zones F and edge zones E include a bottom flange 32, shelf flanges 33, and top flanges 34 that extend generally horizontally from a vertically oriented web or body 35. Individual clips 30 are attached to existing roof 200 by fasteners, such as a screw 39, extending through bottom flange 32 of clips 30 and one of the shoulders 224 adjacent lap ridges 221 in existing panels 220. Additional fasteners, such as two additional screws 39, extend through body 35 of individual clips 30 and lap ridges 221 in existing panels 220.

It will be appreciated that a greater or lesser number of screws 39 or other fasteners may be used to mount individual clips 30 to existing roof 200. Typically at least two fasteners will be used to resist torque about the connections and to provide greater stability for individual clips 30. Where wind uplift is of minimal concern, however, it may be possible to mount individual clips 30 with a single fastener extending through base 32 into shoulder 224 or through body 35 into lap ridge 221. Conversely, additional screws 39 or other fasteners may be installed through base 32 or body 35 when more stability and strength is required in the connection between individual clips 30 and shoulders 224 and lap ridges 221 in existing panels 220.

Individual clips 30 typically will be arranged along lap ridges 221 of existing panels 220 such that they are proximate to, but somewhat offset from existing clips 230 in existing roof 200. Screws 39 or other fasteners may be installed more easily, as the offset ensures that screws 39 do not have to be driven through existing clips 230 or purlins 201. Especially when they are minimally offset from existing clips 230, that usually will provide an adequately strong connection between individual clips 30 and existing roof 200.

Individual clips 30, however, may be substantially aligned with existing clips 230 so that screws 39 are driven through existing clips 230 as well as lap ridges 221. Likewise, screws 39 may be driven through base 32 and shoulders 224 into purlins 201. Other factors being equal, installing fasteners through existing clips 230 or purlins 201 will provide a stronger connection between individual clips 30 and existing roof 200, but may require predrilling or other operations making installation more difficult and time consuming. In that vein, preformed round apertures 36 preferably are provided in base 32 and body 35 of individual clips 30 to accommodate screws or other fasteners. If desired, however, slots may be provided, or screws may be driven through base 32 or body 35.

The length of clips 30 and base 32 thereof, as well as the placement, configuration, and number of apertures 36, preferably are coordinated to allow for some imprecision in placement of clips 30 during installation while ensuring that a sufficient number of fasteners may be driven into the existing roof 200. It also is preferable that individual clip 30 and base 32 be sufficiently long so as to allow for a more stable and secure connection to shoulders 224 and lap ridges 221 in existing panels 220.

Shelf flanges 33 of individual clips 30 have a first more or less horizontal portion which, along with top flanges 34, provides support for recover panels 20. Top flanges 34 also facilitate the formation of standing seams 21 between recover panels 20. That is, as best appreciated from the cross-sectional views of FIGS. 4-5, the lateral edges of panels 20 are bent upwards to provide upwardly extending sides 23 on both sides of trough 22. The upper portion of panel sides 23 is doubled over horizontally to form a narrow u-shaped channel 24 running vertically on top of each side 23 of panels 20. It will be noted that recover panels 20 are symmetrical, that is, their sides 23 are mirror images.

As recover panels 20 are installed, therefore, sides 23 of panels 20 will be supported on the top surfaces of shelf flanges 33 in adjacent lines of clips 30. At the same time, u-shaped channels 24 in the upper portion of sides 23 of panels 20 are slipped over top flanges 34. A seam cover 25 then is provided over and around the exterior of channels 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23.

The exact dimensions of shelf flanges and top flanges in the novel individual clips are not especially critical and may be varied somewhat to provide as much or as little support surface as may be desired or necessary for a particular installation. Likewise, clips 30 have three top flanges 34, two flanges 34 extending in one direction and one flange 34 extending in an opposite direction. Other clips, however, may be provided with any number of top flanges extending in alternating directions.

Figure 7:
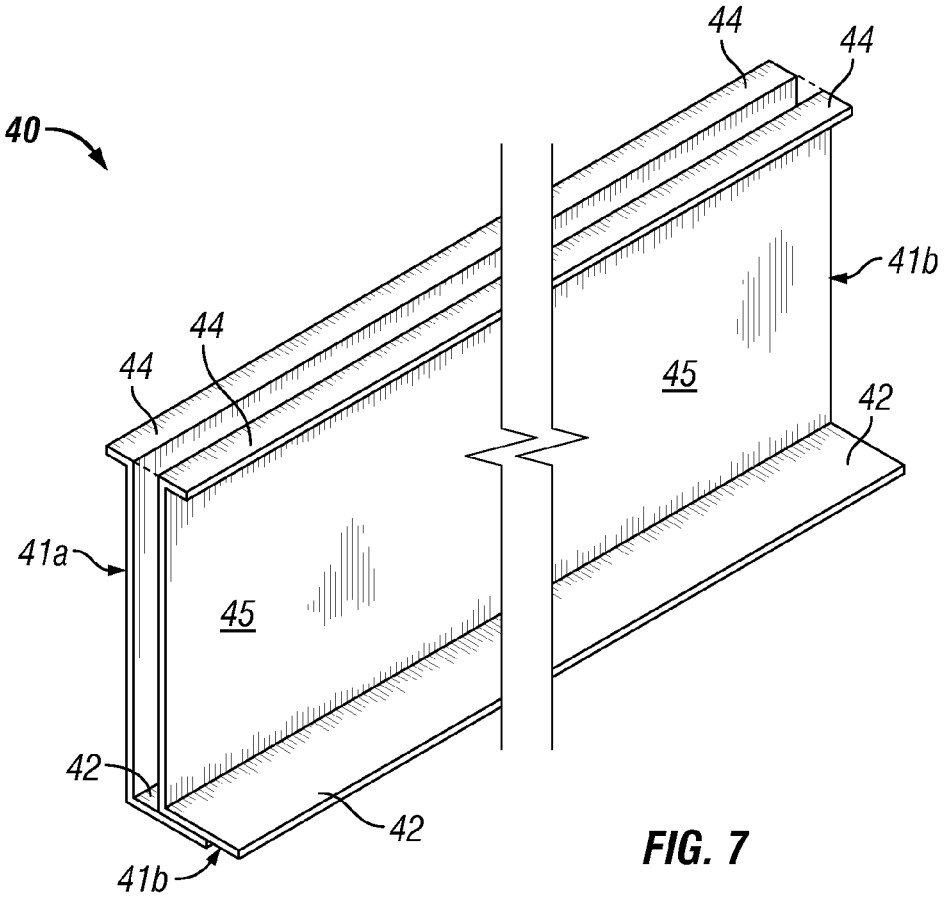
FIG. 7 is an exploded perspective view of a preferred embodiment 40 of continuous panel clips of the subject invention, continuous panel clip 40 being used in novel roof recover 10 shown in FIGS. 1-2 and 4-5.

Continuous clips 40, as seen best in FIG. 7, are formed from two similar, nesting components 41*a* and 41*b*. More particularly, clip components 41 have a bottom flange 42 and a top flange 44 extending generally horizontally from a vertically oriented web or body 45. They are substantially identical except that bottom flange 42*a* of clip component 41*a* and bottom flange 42*b* of clip component 40*b* extend in opposite directions. Body 45*b* of clip component 41*b* also is slightly shorter than body 45*a* of clip component 41*a*, such that when clip components 41 are nested together, their top flanges 44 will be substantially aligned.

Continuous clips 40 are attached to existing roof 200 in a manner similar to individual clips 30. Fasteners, such as screws 49, extend through bottom flanges 42 of clips 40 and one of the shoulders 224 adjacent lap ridges 221 in existing panels 220. Additional fasteners, such as additional screws 49, extend through bodies 45 of continuous clips 40 and lap ridges 221 in existing panels 220. For example, a single screw 49 may be driven through bottom flanges 42 over or proximate to each purlin 201 spanned by continuous clip 40 and a screw 49 driven through bottom flange 42 midway between spanned purlins 201. A pair of screws 49 may be driven through bodies 45 of continuous clips 40 and into lap ridges 221 proximate to, but slightly offset from existing clips 230 on each purlin 201 spanned by continuous clip 40. Installation of screws 49 will proceed more quickly and easily if existing clips 230 and purlins 201 are avoided, and for many installations a sufficiently secure connection between continuous clips 40 and existing roof 200 will be provided. As with individual clips 30, however, one or more of the screws 49 used to secure continuous clips 40 to existing roof 200 may be a driven into existing clips 230 or purlins 201 if a stronger connection is desired. Continuous clips 40, because of their extended length, typically will be fabricated from lighter gauge metal, and thus, screws 49 typically can be driven through them during installation. If desired, however, prefabricated apertures, slots, and the like may be provided therein to accommodate screws or other fasteners.

The length of clip components 41 is coordinated such that clips 40 span at least the distance between adjacent purlins 201 in existing roof 200, but preferably such that clips 40 extend across all purlins 201 in the corner zone of roof 200. The width of base 42, as well as the placement, configuration, and number of any apertures present, preferably are coordinated to allow for some imprecision in placement of clip components 41 during installation while ensuring that a sufficient number of fasteners may be driven into existing roof 200.

Top flanges 44 of continuous clips 40, similar to top flanges 34 in individual clips 30, engage adjacent panels 20 and assist in the formation of a standing seam 21 therebetween. More particularly, top flanges 44 are configured such that sides 23 of panels 20 may be engaged therewith by slipping u-shaped channels 24 around top flanges 44. Seam cover 25 then is placed over and around channels 24 to secure panels 20 to each other and to continuous clips 40. Sealants and seamers also are preferably used to form a secure, weather tight seam along continuous clips 40.

The clips used in the novel metal panel roof recovers preferably are made from steel, such as 16 to 24 gauge galvanized steel sheets that may be easily formed and bent and cut into a desired configuration by conventional metal forming equipment. Such materials provide a rugged, weather resistant clip that may be manufactured easily and economically. Continuous clips, given their length, may be made from somewhat lighter gage metal if desired to reduce costs and to more easily allow screws to be driven through the clip instead of providing apertures to accommodate fasteners. Other metals, such as extruded aluminum, may be used to fabricate the panel clips, however, as well as rigid, moldable or extrudable plastics.

Figure 8:
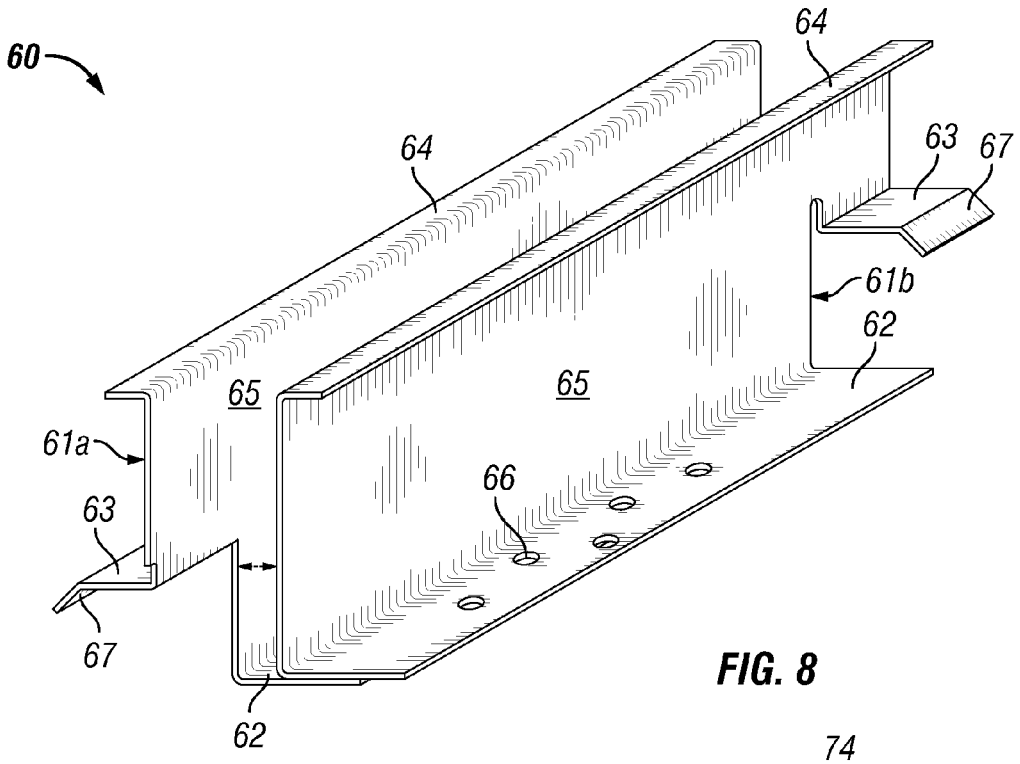
FIG. 8 is an exploded perspective view of a second preferred embodiment 60 of individual panel clips of the subject invention, which individual panel clip 60 may be used in novel roof recover 10 shown in FIGS. 1-2 and 4-5.
Figure 9:
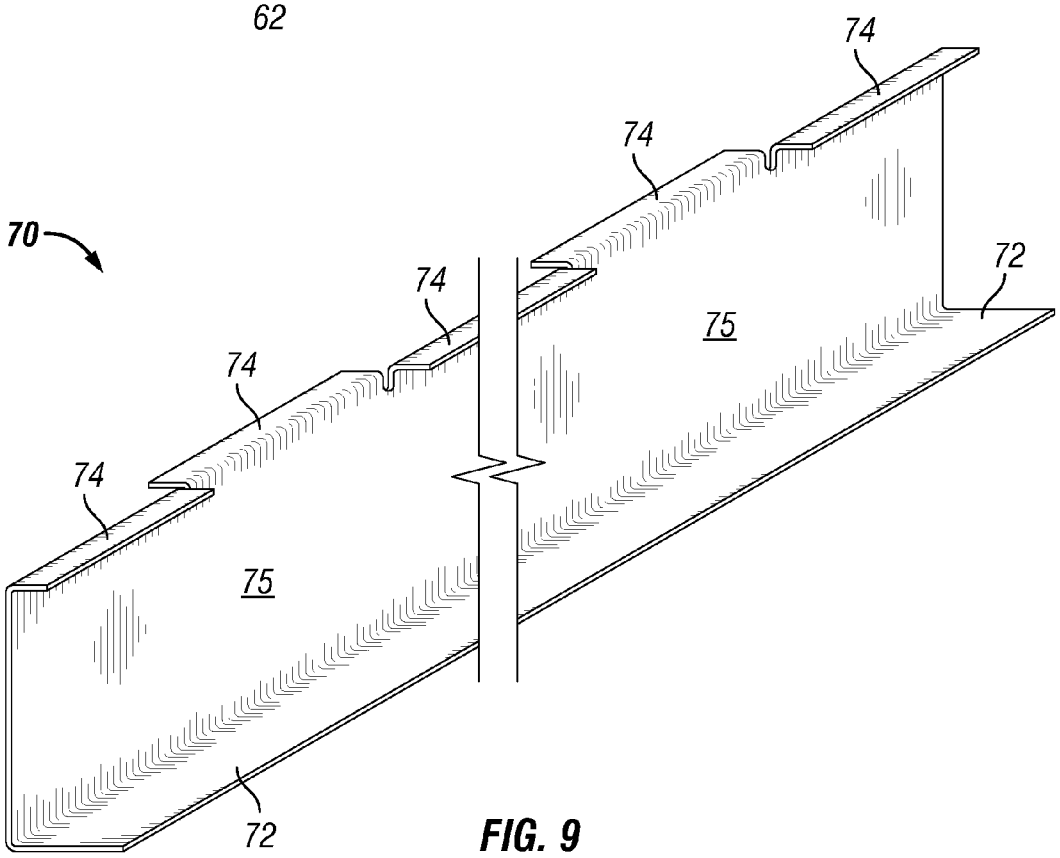
FIG. 9 is a perspective view of a second preferred embodiment 70 of continuous panel clips of the subject invention, which continuous panel clip 70 may be used in novel roof recover 10 shown in FIGS. 1-2 and 4-5.

Likewise, while individual clips 30 and continuous clips 40 are used in preferred embodiments of the novel roof recovers, the invention is not limited thereto. Other clip configurations may be used if desired. For example, while individual clips 30 in novel roof recover 10 are a unitary component, other individual clips suitable for use in other embodiments of the subject invention may have a two-piece design, similar to continuous clips 40, as shown in FIG. 8. Likewise, as shown in FIG. 9, continuous clip 40 may be fabricated as a unitary component, analogous to individual clips 30. The various flanges in the exemplified clips are integral with their associated clip body. If desired, however, the various flanges may be provided as separate components affixed to a clip body, e.g., by welding.

Alternately, continuous support for panel seams across adjacent purlins may be provided by providing a panel support member which straddles two individual clips across their shelf flanges. The panel support member may be attached and secured to individual clips by any means known in the art, such as glue, welding, or fasteners. The panel support member includes a substantially flat upper surface and a bent flange on each edge of the substantially flat upper surface. The substantially flat upper surface of the panel support member is configured to contact and support the recover panel, for example, by engaging u-shaped channels in a manner analogous to that described above. The panel support member essentially connects the individual clips and creates a support structure for the recover panels.

Preferably, the panels of the existing roof will be further secured to the purlins or other support members before recover panels are installed so as to provide a more secure connection between the recover and the existing roof and greater resistance to wind uplift. For example, as shown in FIGS. 2 and 4-5, a screw 229 or other fastener may be driven through shoulder 224 of existing panel 220 into purlin 201. A pair of screws 229 also may be driven through trough 222 of existing panel 220, just inside the panel sides 223, and into purlin 201. Additional screws 229 may be installed, for example, at spaced intervals extending across trough 222 of existing panels 220.

It will be appreciated that when the recover clips are fastened to the shoulders and lap ridges of existing panels and recover panels are attached thereto, space is created for the installation of insulation. When individual clips 30 are installed over existing roof 200, for example, body 25 extends upward a sufficient distance that shelf flanges 33 are situated somewhat above lap ridges 221 in existing panels 220 and, necessarily, well above shorter vertical ridges 226 and trough 222. Likewise, continuous clips 40 suspend recover panels 20 above lap ridges 221 and well above vertical ridges 226 and trough 222 of existing panels 220. Thus, when recover panels 20 are attached to individual clips 30 and continuous clips 40, a clearance or space 50 is created between existing panels 220 and recover panels 20. Spaces 50 may be and preferably are filled with insulation.

The amount of space provided between the existing panels and recover panels and the choice of insulation may be coordinated to provide whatever level of thermal resistance for the cover that may be desired. When materials having higher thermal resistance are used, less space may be provided, and vice versa.

Any of the wide variety of insulating materials commonly used in building construction to reduce heat transfer by conduction, radiation, or convection may be used in the novel recover metal roofs. Such insulating materials include polyurethane, isocyanate, and other spray foam insulation, cotton, rock and slag wool, fiberglass, and other fibrous bats and blankets, cellulose and other blown-in fibrous insulation, and expanded or extruded closed cell polystyrene (EPS and XPS), polyisocyanate, and other rigid plastic foam insulation. Various barrier sheets, films, coatings, and facing also may be provided to provide additional thermal resistance, to minimize water condensation in the insulation, or to provide fire resistance to the insulation.

The choice of insulating materials will depend in large part on the degree of thermal resistance desired and cost considerations. At the same time, however, recover panels will be supported by panel clips only along their seams. Especially in the edge and corner zones, the panel clips provide relatively little support for the trough areas of the panels. Thus, insulation preferably is selected and installed so that it will provide support for the panels in their trough areas. That support preferably is sufficient to allow workers to walk over the recovered roof without causing the panels to sag to a degree that will make a worker uncomfortable or that will damage the seams between recover panels.

For example, in field zones F of recover roof 10 panels 20 are relatively resistant to sagging. Thus, as may be seen in FIGS. 2 and 4-5, a fiberglass blanket 51 may be installed in space 50. Blanket 51 may be rolled between rows of clips 30. Alternately, slits may be provided in blanket 51 such that when it is laid over individual clips 30 they will extend through blanket 51 and allow panels 20 to be attached thereto. If desired, a multiple layers of blankets may be laid crosswise (not shown) in space 50. In any event, shelf flange 33 and, in particular, a downwardly angled extension 37 thereof may assist in holding down blankets Si, or any other insulation components used in the roof recover, as they are installed. Since blankets 51 are easily compressed, they will conform to the dimensions and profile of space 50 once recover panels 20 are attached to clips 30.

Edge zones E and especially corner zones C of recover roof 10, however, have relative low load capacity. In the absence of supporting insulation, workers walking on recover panels 20 may damage seams 21. Thus, rigid insulation, such as rigid plastic foam boards 52 are provided in spaces 50 in the edge zones E and corner zones C as shown in FIG. 2. Foam boards 52 have a generally flat, solid rectangular configuration such that they may be placed over existing panels 220 between adjacent rows of clips 30 and 40 with their sides closely abutting each other. The bottom surface of foam board 52 preferably is profiled to mate more or less with the profile of existing panel 220. The bottom surface of foam boards 52, therefor, will be able to rest more or less continuously across the surface of existing panels 220, thus allowing any load transmitted to the foam to be distributed across a wider area. When foam boards 52 will be installed in areas where individual clips 30 are present, cutouts may be provided (not shown), if desired, to accommodate individual clips 30 and facilitate installation of foam boards 52. Wider foam boards spanning across seam lines also may be provided with openings to accommodate individual panel clips.

Foam boards 52 preferably are composed of relatively dense high load capacity rigid plastic foam, such as expanded or extruded closed cell polystyrene. They may comprise facing, such as various barrier sheets, films, and coatings designed to provide a vapor barrier, to reflect radiant heat, or to provide fire resistance, or they may be unfaced. Preferably, foam boards will have a load capacity of at least about 25 pounds per square inch (psi). If desired, however, a somewhat less dense, lower load capacity foam may be used in edge zones E, such as a foam having a load capacity of a least about 18 psi. Less dense foam may provide sufficient support in edge zones E while reducing costs somewhat, the cost of such foam insulation being directly correlated to its density. On the other hand, foam boards also may be provided in all or part of field zones F of recover roof 10 if additional load capacity in those zones is desired.

It will be appreciated that the novel standing seam roof recovers almost invariably require the use of other components to complete certain portions of a recover installation. For example, if the roof includes a number of different fields, ridge caps will be provided along the peak and hip lines of the roof, and specialized connectors may be required for their installation. Similarly, flashing may be installed in roof valleys and around projections through the roof. Facia and soffit components also may be installed along the eaves and gables of the roof. A wide variety of such components and installation methods are known in the art and may be used in the novel roof recovers.

The novel metal panel roof recovers thus far has been exemplified in relation to trapezoidal standing seam metal roofs and to existing metal roof 200 in particular. It is to be understood, however, that the novel roof recovers may be installed over other types of existing standing seam roofs without departing from the principles of the present invention. For example, the novel roof recovers may be installed over non-trapezoidal panels which lack a shoulder, such as the P-12 and P-16 Classic Series panel systems commercially available from MBCI, Houston, Tex. (www.mbci.com). Such panels are described on the MCBI website, e.g., at http://www.mbci.com/classic.html and http://www.mbci.comlpdf/catalogs/Web_ARCH%20PRICING%20(Effective%201-20-2014).pdf, the disclosures of which are incorporated in their entirety herein by this reference thereto.

As disclosed therein and as known by workers in the art, the MBCI Classic series panels are asymmetrical, mechanically seamed, standing seam panels. The Classic series panel system is similar to the standing seam panels systems exemplified by existing roof 200 except that the panels and clips are configured somewhat differently. Classic series panels, as are panels 220 in existing roof 200, are installed such that they run vertically, that is, with the slope and across purlins, such as purlins 201. Classic series panels also have upturned, upstanding sides that define a trough extending across the substantial width of the Classic series panels.

As are panels 220 in existing roof 200, Classic series panels are installed and seamed together on panel clips which are mounted on purlins or other horizontally extending support members in linear arrays running vertically across the purlins. The panel clips used to install Classic series panels are simple right-angle clips, having a horizontal base with an somewhat elongated body portion extending upwards from one edge of the base more or less at a right angle thereto. The Classic series panel clips, similar to panel clips 230 in existing roof 200, are arranged in linear arrays running vertically across the purlins and are secured to the purlins by, e.g., penetrating fasteners such as screws. Classic series panels are disposed between linear arrays of clips.

Being asymmetrical, the seam sides are configured such that the lateral edges, that is, the upper portion of the seam sides of adjacent panels nest one into the other when installed. The nested lateral edges of seam sides of adjacent panels then are mechanically formed into lap ridges over the clips. When mechanically formed, adjacent panels form a sidelap that may be visualized as an upside-down "L". The upstanding portion of adjacent panel sides abut and extend upward generally perpendicular to the panel trough, with a mechanically formed, doubled-over overlap extending more or less at right angles to the upstanding portion of the sidelap.

Novel roof recover may be installed over an existing Classic series roof in a manner similar to that exemplified above in respect to roof recover 10 and existing roof 200. Preferably, the panels of the existing Classic series roof first will be further secured to the purlins or other support members before recover panels are installed so as to provide a more secure connection between the recover and the existing roof and greater resistance to wind uplift. For example, screws or other fasteners may be driven through the trough of existing Classic series panels and into the purlins. A plurality of screws may be installed, for example, at spaced intervals extending across the trough of the existing Classic series panels.

Individual clips 30 and continuous clips 40, for example, then may be used to secure recover panels 20 over an existing Classic series roof and to facilitate the formation of seams 21 between laterally adjacent panels 20 in much the same way as shown in FIGS. 2 and 4-5 in respect to existing roof 200. Recover clips are disposed in linear arrays running vertically across the existing Classic series roof. As in existing roof 200 and recover 10, individual clips may be installed in the field of an existing roof and continuous clips may be installed in corner zones, and either individual or continuous clips may be installed in edge zones of the existing roof to provide additional resistance to wind uplift, if desired.

Recover individual clips 30 and continuous clips 40, for example, may be attached to the existing Classic series panels by fasteners, such as screws 39 and 49, extending through the side laps formed between adjacent Classic series panels, such as the upstanding portion thereof. Recover individual clips 30 and continuous clips 40 may be sized such that they extend, when installed, down to and rest on the trough in the existing panels, or they may be somewhat shorter.

For example, individual clips 30 may be installed to sidelaps in an existing Classic series roof such that their shelf flanges 33 extend over the top, horizontal portion of the upside-down "L" shaped sidelap and their vertically oriented bodies 35 are abutting the upstanding portion of the Classic series sidelaps. Individual clips 30 may be secured to the existing Classic series roof by fasteners, such as a screws, which extend through the body portion 35 of individual clips 30 and the sidelap of adjacent Classic series panels. Fasteners also may be driven through shelf flanges 33 into the sidelaps, but in many cases the clip will be sufficiently stabilized if fasteners are driven only though the body portion 30. The combination of the fastener and the shelf flange 33 may provide sufficient resistance to torque created between the clip and the sidelap.

Continuous clips 40 may be installed in a similar fashion by securing them to the sidelaps in adjacent Classic series panels, for example, by driving screws or other fasteners through body portions 41 and the upstanding portion of the sidelaps. Once individual clips 30 and/or continuous clips 40 have been installed, recover panels 20 may be installed on the clips in the same manner as described above in reference to recover 10 and existing roof 200. As in recover 10, when a recover is installed above an existing Classic series roof, insulation may be provided, either in the form of batts or foam boards as described above.

Figure 10:
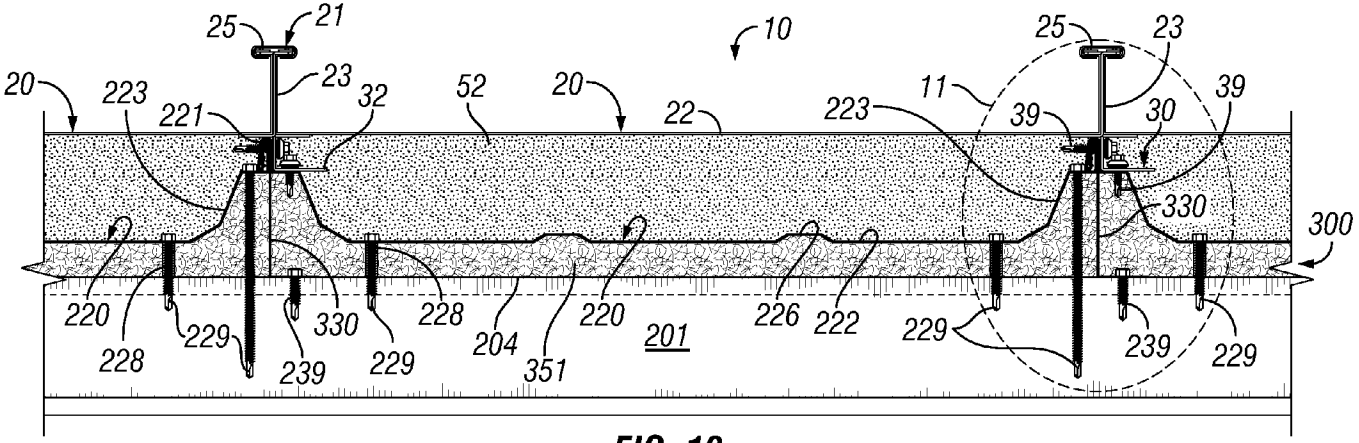
FIG. 10 is a cross-sectional view similar to the view of FIG. 4 of another conventional metal panel roof 300 which has been recovered with novel roof recover 10.
Figure 11:
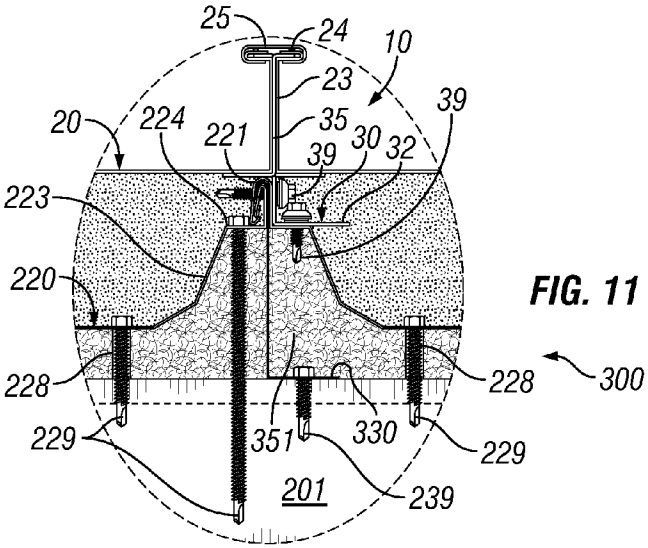
FIG. 11 is an enlarged, detailed view of portion 11 of the view shown in FIG. 10.

The novel roof recovers have been thus far been exemplified in the context of uninsulated existing roofs, but they also may be installed over existing roofs that have insulation. For example, roof recover 10 may be installed over conventional insulated roof 300 as shown in FIGS. 10-11. Roof 300 is substantially similar to roof 200, except that clips 330 of existing roof 300 support panels 220 above the surface of purlins 201, creating a space 350 between the bottom of panels 220 and the surface of top flange 204 of purlins 201. Insulation, such as insulation bans 351, are disposed in space 350.

Recover 10 is installed over existing roof 300 in much the same way as it is installed over roof 200. Existing panels 220 preferably are secured to purlins 201 by screws 229 or other fasteners installed through shoulder 224 and troughs 222 generally as described above. Preferably, however, spacers 228 are provided between the head of screws 229 installed in trough 222 and purlins 201. Spacers 228 may be, for example, short metallic cylinders inserted through a pre-drilled hole in trough 222 of existing panels 220. The length and diameter of spacer 228 is coordinated such that downward travel of screw 229 is limited, thus avoiding deformation of existing panels 220 and the creation of stress on lap ridges 221 in existing roof 300. A spacer also may be provided, if desired, under screw 229 which is installed through shoulder 224 of existing panel 220. Individual clips 30 and continuous clips 40 then are installed, and recover panels 20 mounted thereon as described above to complete installation of recover 10 over existing roof 300.

While this invention has been disclosed and discussed primarily in terms of specific embodiments thereof, it is not intended to be limited thereto. Other modifications and embodiments will be apparent to the worker in the art.

What is claimed is:

1. A metal panel standing seam roof recover system installed over an existing metal panel standing seam roof having a pitch, (a) said existing metal panel standing seam roof comprising:

i) a support frame which includes an array of spaced purlins running across the pitch of said existing roof, ii) a plurality of panel clips attached to said purlins and arranged in linear arrays running along the pitch of said existing roof, and iii) a cover attached to said panel clips, said cover comprising a plurality of elongated metal cover panels having upstanding sides with a trough therebetween, said sides defining shoulders and lateral edges, said cover panels being interconnected along adjacent said lateral edges by sidelaps formed on said panel clips, said cover sidelaps extending along the pitch of said existing roof and extending vertically from said shoulders on adjacent said cover panels; and (b) said metal panel standing seam roof recover system comprising:

i) a plurality of recover panel clips mounted to said existing roof and arranged in linear arrays running along the pitch of said existing roof, said recover panel clips being mounted to said cover panels by a clip fastener extending through a said cover sidelap or through one of said shoulders adjacent said cover sidelap; and ii) a recover attached to said recover panel clips, said recover comprising a plurality of elongated metal recover panels having upstanding sides defining lateral edges with a trough therebetween, said recover panels being interconnected along adjacent said lateral edges by sidelaps formed on said recover panel clips.

2. The installed recover system of claim 1, wherein said recover panel clips are mounted to said cover panels by a first said clip fastener extending horizontally through a said cover sidelap and a second said clip fastener extending vertically through one of said shoulders adjacent said cover sidelap.

3. The installed recover system of claim 2, wherein said recover system comprises cover fasteners attaching said cover panels to said purlins.

4. The installed recover system of claim 2, wherein said first clip fastener does not extend through a said panel clip in said existing roof.

5. The installed recover system of claim 2, wherein said second clip fastener does not extend into a said purlin in said existing roof.

6. The installed recover system of claim 5, wherein said recover system comprises cover fasteners attaching said cover panels to said purlins.

7. The installed recover system of claim 2, wherein said recover panel clips comprise a vertical body and a horizontal bottom flange, wherein said first clip fastener extends through said clip body and said second clip fastener extends through said clip bottom flange.

8. The installed recover system of claim 1, wherein said recover system comprises cover fasteners attaching said cover panels to said purlins.

9. The installed recover system of claim 8, wherein said cover fasteners comprise fasteners extending through the other said shoulder adjacent said cover sidelap.

10. The installed recover system of claim 8, wherein said cover fasteners comprise fasteners extending through said trough of said cover panels.

11. The installed recover system of claim 8, wherein said cover panels in said existing roof are spaced above said purlins and said cover fasteners include a spacer extending between said fastener and said purlin.

12. The installed recover system of claim 1, wherein said recover panel clips are mounted to said cover panels in said existing roof by a first said clip fastener extending through a said cover sidelap in said existing roof and a second said clip fastener extending through one of said shoulders adjacent said cover sidelap and wherein said recover system comprises a cover fastener extending through the other said shoulder adjacent said cover sidelap and a cover fastener extending through said trough of said cover panels in said existing roof.

13. The installed recover system of claim 1, wherein said cover panels in said existing roof are asymmetrical.

14. The installed recover system of claim 1, wherein said cover sidelaps in said existing roof are mechanically seamed sidelaps, snap-in sidelaps, or hook and roll in place sidelaps.

15. The installed recover system of claim 1, wherein said recover panel clips include individual panel clips installed in a field zone of said existing roof and continuous panel clips installed in a corner zone of said existing roof.

16. The installed recover system of claim 1, wherein said recover panels in said roof recover system are symmetrical panels.

17. The installed recover system of claim 1, wherein said recover panel clips include individual panel clips installed in a field zone of said existing roof and continuous panel clips installed in an edge zone of said existing roof.

18. A method of installing a metal panel standing seam recover over an existing metal panel standing seam roof having a pitch, wherein:

(a) said existing metal panel standing seam roof comprises:

i) a support frame which includes an array of spaced purlins running across the pitch of said existing roof, ii) a plurality of panel clips attached to said purlins, and iii) a cover attached to said panel clips, said cover comprising a plurality of elongated metal panels having upstanding sides, said sides defining shoulders and lateral edges, said cover panels being interconnected along adjacent said lateral edges by sidelaps formed on said panel clips, said cover sidelaps extending vertically from said shoulders on adjacent said cover panels;

(b) wherein said method comprises:

i) providing an array of recover panel clips on said existing roof by attaching said recover panel clips to a said vertically extending cover sidelap in said existing roof or to one of said shoulders adjacent said cover sidelap; and ii) attaching elongated metal recover panels to said recover panel clips by forming sidelaps on said recover panel clips.

19. The method of claim 18, wherein said method comprises attaching said recover panel clips to said vertically extending cover sidelap in said existing roof and to one of said shoulders adjacent said cover sidelap.

20. The method of claim 19, wherein method comprises providing an array of individual recover panel clips in a field zone of said existing roof and providing continuous panel clips in an edge zone or corner zone of said existing roof.

21. The method of claim 19, wherein said method comprises attaching said cover panels in said existing roof to said purlins by installing cover fasteners through said cover panels into said purlins.

22. The method of claim 18, wherein method comprises providing an array of individual recover panel clips in a field zone of said existing roof and providing continuous panel clips in an edge zone or corner zone of said existing roof.

23. The method of claim 18, wherein said method comprises attaching said cover panels in said existing roof to said purlins by installing cover fasteners through said cover panels into said purlins.

24. A metal panel standing seam roof recover system installed over an existing metal panel standing seam roof having a pitch, (a) said existing metal panel standing seam roof comprising:

i) a support frame which includes an array of spaced purlins running across the pitch of said existing roof, ii) a plurality of panel clips attached to said purlins and arranged in linear arrays running along the pitch of said existing roof, and iii) a cover attached to said panel clips, said cover comprising a plurality of elongated metal cover panels having upstanding sides with a trough therebetween, said cover panels being interconnected along adjacent said upstanding sides by sidelaps formed on said panel clips, said cover sidelaps extending along the pitch of said existing roof and extending vertically from said cover panels; and (b) said metal panel standing seam roof recover system comprising:

i) a plurality of recover panel clips mounted to said existing roof and arranged in linear arrays running along the pitch of said existing roof, said recover panel clips being mounted to said cover panels by a clip fastener extending through a said cover sidelap; and ii) a recover attached to said recover panel clips, said recover comprising a plurality of elongated metal recover panels having upstanding sides defining lateral edges with a trough therebetween, said recover panels being interconnected along adjacent said lateral edges by sidelaps formed on said recover panel clips.

25. The installed recover system of claim 24, wherein said recover system comprises cover fasteners attaching said cover panels to said purlins.

* * * * *